United States Patent [19]

Riesgo

[11] Patent Number: 4,804,321

[45] Date of Patent: Feb. 14, 1989

[54] SPREADER TOOL FOR CEMENTITIOUS MIX

[76] Inventor: Armando Riesgo, 11510 SW. 34th La., Miami, Fla. 33165

[21] Appl. No.: 182,855

[22] Filed: Apr. 18, 1988

[51] Int. Cl.[4] ..... B28B 19/00

[52] U.S. Cl. ..... 425/87; 15/235.6; 118/413; 118/415; 156/574; 156/579; 401/5; 401/139; 401/266; 425/458

[58] Field of Search ..... 425/59, 62, 63, 64, 425/96, 101, 219, 224, 87, 458, 113, 464; 156/574, 579; 118/413, 415; 15/235.6, 242; 401/5, 9, 28, 130, 137, 139, 265, 266, 193

[56] References Cited

U.S. PATENT DOCUMENTS

| | | | |
|---|---|---|---|
| 2,054,448 | 9/1936 | Russell | 118/415 |
| 3,289,241 | 12/1966 | Garrison et al. | 118/415 |
| 4,032,283 | 6/1977 | Johnson et al. | 425/458 |

FOREIGN PATENT DOCUMENTS

| | | | |
|---|---|---|---|
| 2709771 | 9/1978 | Fed. Rep. of Germany | 401/5 |

*Primary Examiner*—Jay H. Woo
*Assistant Examiner*—James C. Housel
*Attorney, Agent, or Firm*—John C. Malloy

[57] ABSTRACT

A spreader tool for use in spreading a bed of predetermined thickness of cementitious material on the floor surface prior to laying tiles wherein the tool is composed of a frame having front, rear and side walls and which is open at the top and the bottom so that a charge of the mix may be positioned between the frame members and moved across a floor with the material being discharged through a mouth formed in the frame by an inclined rearwardly extending septum and wherein a rake is provided in the discharge zone of the frame so that the bed being spread on the floor has grooves in the top surface of it.

8 Claims, 2 Drawing Sheets

SPREADER TOOL FOR CEMENTITIOUS MIX

FIELD OF THE INVENTION

This invention relates to a tool for use in spreading a cementitious mix to form a bed in which tile are positioned on the floor.

BACKGROUND OF THE INVENTION

In the past, there have been numerous tools which are utilized for spreading various materials and for applying cementitious mix to a floor surface. Ordinarily, this is a time-consuming job which requires that the person installing the bed be on his knees and moving around on the floor. Such floor surfaces are often relatively uneven and it is therefore necessary that the bed vary somewhat in thickness in order to provide a smooth level top surface in which the tiles are positioned. This invention is of a tool for use in spreading a cementitious mix for a bed for tile to be positioned and which tool includes means to compensate for an uneven floor so that a level top surface of a bed being installed is achieved.

It is, accordingly, an object of this invention to provide an improved tool for use in spreading cementitious mix to form a bed for tile to be applied to a floor, notwithstanding the fact that the floor may be somewhat uneven. It is composed of an open topped and open bottomed frame bounded by walls which define a cavity into which a charge of the mix may be placed and then moved across the floor while captivated within the cavity by the frame and wherein a mouth is provided adjacent the front wall of the frame and an inclined septum is arranged within the frame and at the mouth to distribute the mix being discharged evenly past a rake means at the mouth to provide grooves in the deposited bed.

It is another object of this invention to provide a device of the type described which is simple and inexpensive to manufacture, highly advantageous for use in spreading a bed of cementitious mix for setting tile therein.

In accordance with these and other objects which will become apparent hereinafter, the instant invention will now be described with reference to the accompanying drawings in which:

DESCRIPTION OF THE PREFERRED EMBODIMENT

Figure 1:
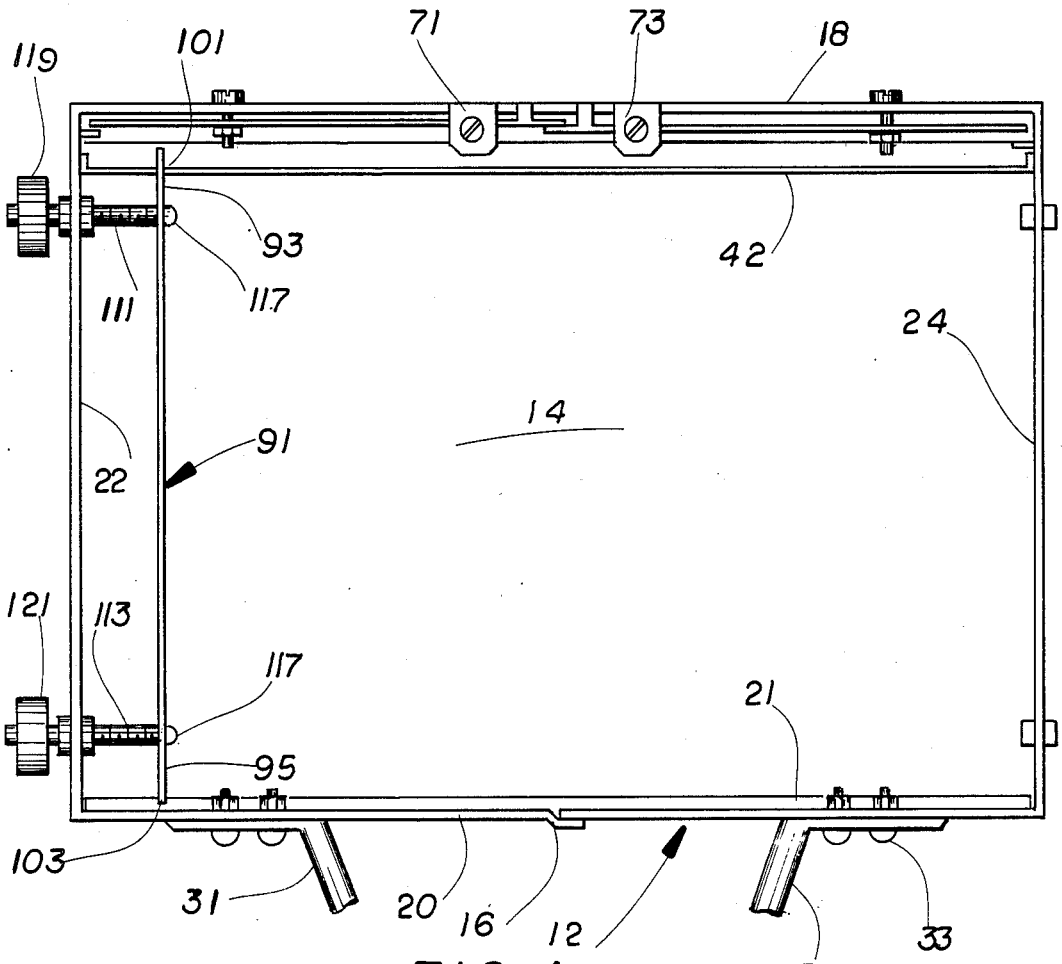
FIG. 1 is a plan view of the tool of the instant invention.
Figure 2:
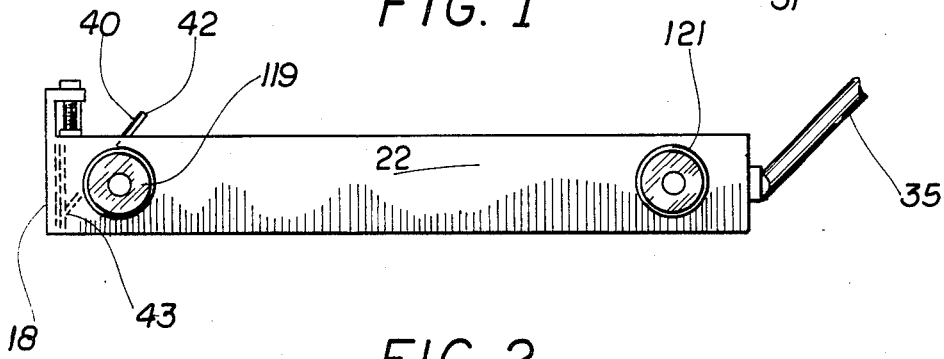
FIG. 2 is a side elevation view which is partly broke away and illustrating the tool.
Figure 3:
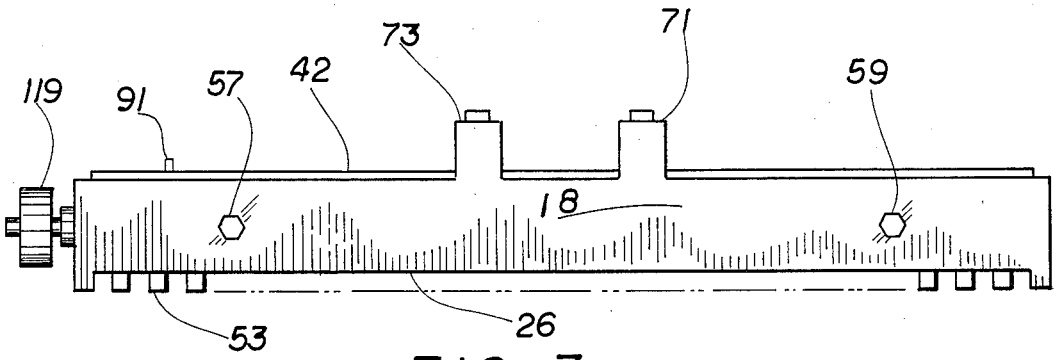
FIG. 3 is a front elevation view of the head of the tool.
Figure 4:
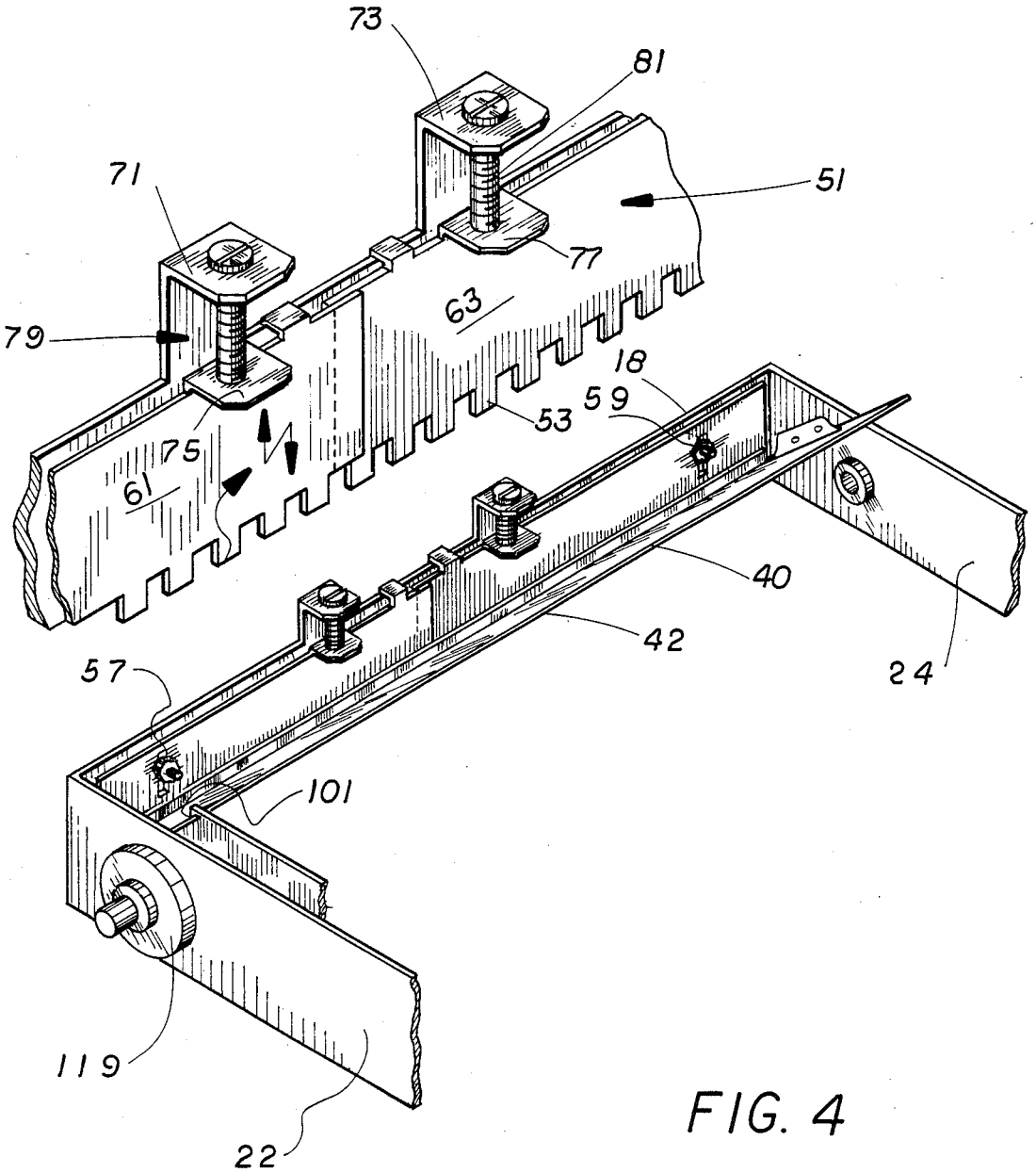
FIG. 4 is a partial perspective view illustrating the construction of the instant invention.

Referring to the drawings, like reference characters designate like or corresponding parts throughout the several views. The tool is shown generally in FIG. 1 and is designated by the numeral 12. It is for use in spreading a charge of cementitious material in a cavity 14 to make a bed of predetermined thickness on a floor surface prior to laying tile. The tool includes a frame which, generally, defines the head of the tool. It may be composed of a stainless steel strap connected together as by welding at 16 defining a open topped and open bottomed member including a front wall 18, rear wall 20 and opposing side walls 22 and 24. It may include a plate guide 21 as is explained more fully hereinafter welded to the interior surface of the rear wall. Each of the walls has a top, bottom and inside and outside surface and the side and rear walls are of a height greater than two inches and preferably about five inches in height. The bottom edges of the side and rear walls are generally coplaner while the bottom 26 of the front wall is spaced above the coplaner bottom edge of the sides and rear wall a distance substantially equal to the thickness of a bed to be spread. To the frame and preferably to the rear wall a connector 31 is secured as by the bolts one of which is designated by the numeral 33 for the purpose of connecting a handle 35 for use in manipulating the tool. As seen in FIGS. 2 and 4, a septum 40 spins the side walls. This septum is rearwardly inclined and has a top edge 42. The bottom edge 43 is parallel to the front wall and spaced above the coplaner frame bottom defining a discharge mouth for material in the frame between the septum and side and rear walls. This material is discharged as the spreader tool is moved over a floor surface. The septum bottom edge 43 is closely adjacent the frame front wall and at a height substantially equal to the thickness of the bed being prepared.

Rake means generally designated by the numeral 51, see FIG. 4, are provided on the frame between the front wall 18 and the rearwardly inclined septum 40. The rake means include a plurality of rake teeth such as 53 and the teeth of the rake means extend below the bottom edge of the septum and front wall of the frame and toward the coplaner bottom edges of the side and rear walls of the frame. It is intended that the teeth will extend into the bed being prepared to provide grooves in the top surface of the bed. The rake means includes mounting means 57 and 59 which preferably comprise pin and slot means to permit vertical movement of adjustment of the rake teeth to compensate for unevenness of a floor surface. In a preferred embodiment, the rake means include a first and second parallel rake segment 61 and 63 each with some of the plurality of rake teeth which extending across the discharge mouth of the tool. Thus, in response to movement over a surface, the rake adjusts automatically as it is being moved to compensate. In a preferred embodiment, the front wall 18 includes a rearwardly extending abutment means 71 and 73, at least one of which is on each of the plates. In a companionment location on each of rake segments there is a corresponding abutment means 75 and 77 with a spring captivated between the abutment means as indicated by the numerals 79 and 81. These springs urge the teeth downwardly into the discharge mouth zone while at the same time permitting yielding movement of adjustment as the tool is moved over a floor surface.

In a preferred embodiment, the interior of the frame is provided with an interior movable wall 91 which at its forward end and rearward end 93 and 95 respectively, includes a notch as at 101 and 103 for hooked up engagement with the top edge 42 of the front septum and the rear plate 21. Thus, push/pull rods 111 and 113 which are threaded and fixed at their ends 115 and 117 to the temporary wall are adapted to be threadably advanced and retracted by means of operators 119 and 121 to threadably advance or retract the wall to adjust the size of the cavity 14. In a preferred embodiment, the septum is at an angle of about 45 degrees and is about 0.125 inches thick of stainless steel plate spot-welded to the sides of the frame. The handle 35 may be of plastic while the rake plates carrying the teeth are also preferably of stainless steel of about 0.125 inches thick with each of the teeth being about ¼ inch deep spaced from one another about ¼ of an inch and about ¼ of an inch wide each. It is preferred that the lateral dimension of the front wall of the frame be 30 inches and that the length of the side walls be about 8 to 12 inches in length. It is thus seen that there is provided a simple and inexpensive tool which can readily be utilized for spreading mix as a bed for applying a tile to a floor surface which compensates by reason of the foregoing structure for unevenness of the floor surface.

While an abutment surface has been provided for each of the rake segments, it will be appreciated that additional abutment surfaces for the front wall and the rake segments may be provided so that the rake moves upwardly against the spring pressure and tilting of the segments is avoided by means of additional anti-tilt towers or spring means.

While the instant invention has been shown and described in what is considered to be a practical and preferred embodiment, departures may be made within the spirit and scope of this invention which should therefore not be limited except as set forth in the claims which follow and within the doctrine of equivalents.

What is claimed is:

1. A spreader tool for use in spreading a bed of predetermined thickness of cementitious mix on a floor surface prior to laying tiles, said tool comprising:

an open topped and an open bottomed frame including a front wall, a rear wall and a pair of generally parallel opposing side walls, said walls each having a top, bottom, and inside and outside surfaces, the bottoms of said frame side and rear walls being generally coplanar and the bottom of said front wall being spaced above the bottoms of said side and rear walls a distance substantially equal to the thickness of the bed to be spread, said walls defining a cavity to receive a charge of said mix for movement of the charge within the walls over a floor surface, handle connector means on said frame, and a handle extending upwardly away from said frame, a rearwardly inclined septum extending upwardly within the frame and spanning the side walls, said septum having a top edge and a bottom edge, said septum bottom edge being parallel to the front wall and spaced above the coplanar side and rear wall bottoms defining a discharge mouth for material in the frame between the septum and side and rear frame walls for discharge as the spreader tool is moved over a floor surface, said septum bottom edge being closely adjacent said frame front wall a height substantially equal to the bed being spread, rake means being resiliently carried on the frame between the front wall and septum and including a plurality of rake teeth each having a distal end and extending below said bottom edge of said front wall toward said coplanar side and rear wall bottoms to extend into a bed being laid to provide grooves therein.

2. The tool as set forth in claim 1 wherein said rake means includes means resiliently mounting said rake means to permit substantially vertical movement of adjustment of said rake teeth to compensate for unevenness of a floor surface.

3. The tool as set forth in claim 2 wherein said rake means includes a first and a second parallel rake segment each with some of said plurality of rake teeth.

4. The tool as set forth in claim 3 wherein said rake means ,includes a pair of parallel plates and said means resiliently mounting said rake means includes guide means on the front wall constraining the rake parallel plates to substantially vertical movement only from a lower normal position with the distal ends of said teeth substantially on the same plane as the coplanar bottoms of said rear and side walls and said rake means includes biasing means urging said distal ends of said teeth toward said normal position and yieldable to vertical movement of adjustment in response to movement of the tool in spreading a bed on an uneven floor surface.

5. The tool as set forth in claim 4 wherein said guide means include pin and slot means connecting the front wall and said parallel plates.

6. The tool as set forth in claim 4 wherein said front wall includes rearwardly extending spring abutment means and companionly located rearwardly extending spring abutment means on the parallel plates and a compression spring means captivated between said abutment means of said front wall and parallel plates for substantially resilient vertical movement of said rake plates.

7. The tool as set forth in claim 1 wherein the frame includes an internal wall extending from said septum to said rear wall parallel to said side walls and means to adjust the location of said internal wall between said side walls to vary the size of said cavity.

8. The tool as set forth in claim 7 wherein said means to adjust the location comprises a notch in said internal wall in hooked up-sliding relation on the top edge of said septum and spaced threaded push/pull rods extending from said internal wall in parallel relation and through one of said frame side walls and operator means on the push/pull rods to turn the rods thereby extending said rods relative to said one of said frame side walls.

* * * * *